US005771647A

United States Patent [19]

Kempen et al.

[11] Patent Number: 5,771,647

[45] Date of Patent: Jun. 30, 1998

[54] GRILLE ASSEMBLY AND RELATED METHOD

[75] Inventors: Tony J. Kempen; Kenneth E. Prochnow, both of Madison, Wis.

[73] Assignee: Carnes Company, Inc., Milwaukee, Wis.

[21] Appl. No.: 722,483

[22] Filed: Sep. 27, 1996

[51] Int. Cl.[6] ..... E04B 1/70

[52] U.S. Cl. ..... 52/302.1; 52/473; 403/383; 403/282; 454/331; 454/279

[58] Field of Search ..... 52/656.7, 656.8, 52/473, 302.1; 454/330, 331, 277, 279, 280, 284, 286, 288, 299, 308, 309; 403/383, 382, 361; 72/176, 262; 49/80.1, 371

[56] References Cited

U.S. PATENT DOCUMENTS

| | | | |
|---|---|---|---|
| 434,295 | 8/1890 | Ricardi . | |
| 593,178 | 11/1897 | Lehr et al. . | |
| 1,428,230 | 9/1922 | Hess | 454/331 X |
| 2,230,707 | 2/1941 | Wallace | 49/80.1 X |
| 2,628,861 | 9/1953 | Greig | 296/97 |
| 2,696,018 | 12/1954 | Hollister | 16/128 |
| 3,064,452 | 11/1962 | Gast, Jr. | 64/5 |
| 3,261,638 | 7/1966 | Weingarten | 296/97 |
| 3,283,402 | 11/1966 | Larson | 29/512 |
| 3,403,475 | 10/1968 | Degenhart | 49/371 |
| 4,261,436 | 4/1981 | Stillman, Jr. | 29/512 X |
| 4,533,275 | 8/1985 | Foggini | 403/165 |
| 4,752,993 | 6/1988 | Oaks | 29/21.1 |
| 4,757,594 | 7/1988 | Kars et al. | 29/447 |
| 4,791,828 | 12/1988 | Kaye et al. | 74/545 |
| 4,836,705 | 6/1989 | La Barge et al. | 403/282 |
| 5,293,920 | 3/1994 | Vagedes | 52/302.1 X |
| 5,507,691 | 4/1996 | Nishizawa | 454/279 |

FOREIGN PATENT DOCUMENTS

| | | | |
|---|---|---|---|
| 1045442 | 1/1979 | Canada | 454/330 |

*Primary Examiner*—Creighton Smith
*Attorney, Agent, or Firm*—Jansson, Shupe, Bridge & Munger, Ltd.

[57] ABSTRACT

Disclosed is an air-flow-directing grille assembly of the type having two frame members and a grille bar supported by such frame members for pivoting movement about a grille bar axis. In the improvement, each frame member has a hole, the bar has an axle extending through the holes and each hole and the axle are cooperatively sized to provide a friction fit between such hole and axle. The grille bar is thereby frictionally retained in a position. A new method for making a grille assembly includes providing a pair of frame members, each having a hole therethrough of a first diameter. A grille bar is provided to have an axle with a second diameter at least equal to the first diameter. The axle and the frame member holes are urged into frictional engagement with one another and the grille bars will thereby hold a selected air-flow-directing position.

9 Claims, 5 Drawing Sheets

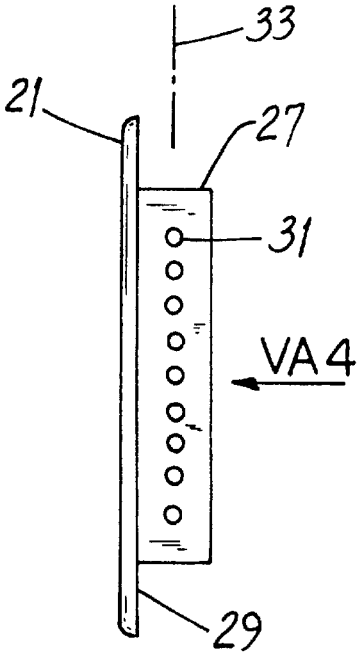
FIG. 3
FIG. 4
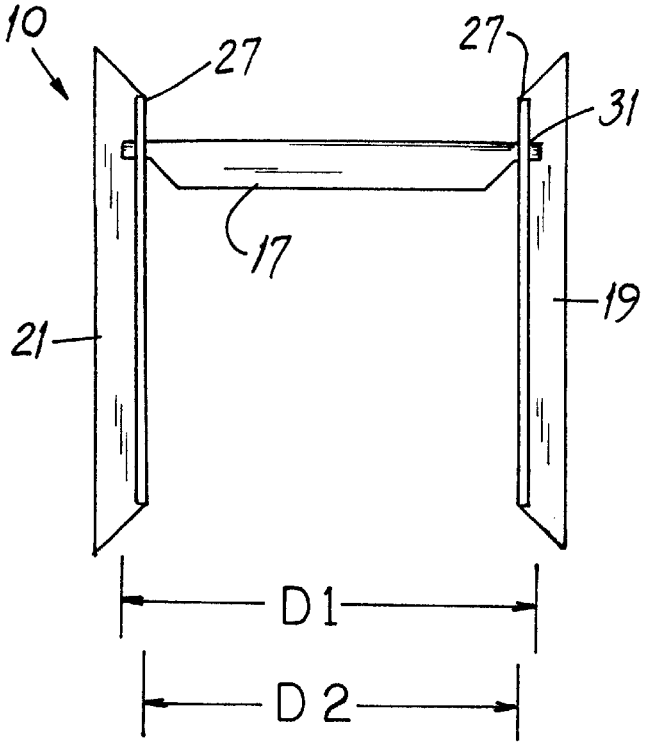
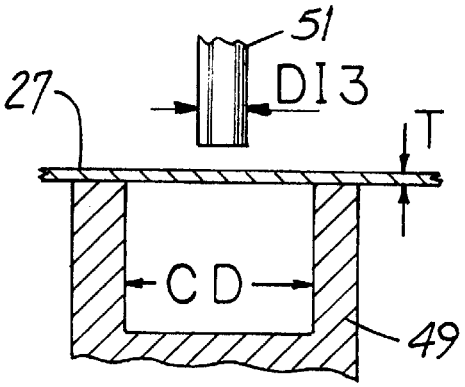
FIG. 9
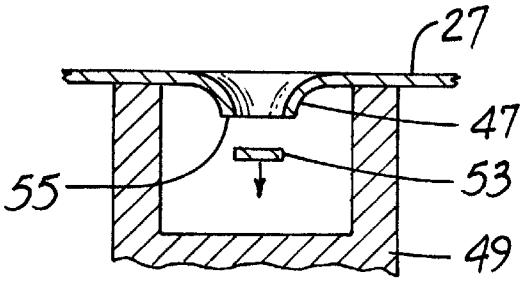
FIG. 10

GRILLE ASSEMBLY AND RELATED METHOD

FIELD OF THE INVENTION

This invention relates generally to joints and connections and, more particularly, to joints and connections used in air-flow-directing grille assemblies.

BACKGROUND OF THE INFORMATION

Registers, grilles and the like are used to direct the flow of air being delivered into a room by, for example, a heating or air conditioning system. Exemplary registers and grilles include a rectangular frame to which is mounted a number of grille bars. Each grille bar includes an air-flow-directing blade and an axle mounted to the frame for pivoting movement. Often (but not always), the grille bars are arranged to move in unison so that the room occupant can direct air left/right, up/down.

A common method of attaching a blade axle to a frame (such method being further described in the specification) involves forming a hole in the frame, inserting the head of a retention pin through the hole, staking the head to expand it and then urging the axle onto the pointed end of the pin. The hole in the axle and the pointed end of the pin are cooperatively sized to provide at least a friction fit. Blades are held in a selected position by the friction between axle and pin. If the frame and grille bars are painted using an electro-deposition process, an electrically-conductive metal pin is preferred.

While the aforedescribed approach has been generally satisfactory, it requires a multiplicity of parts (including two pins for each grille bar) and several manufacturing steps. A new method and related grille assembly which overcomes some of the problems and shortcomings of known methods and assemblies would be a distinct advance in the art.

OBJECTS OF THE INVENTION

It is an object of the invention to provide an improved grille assembly and related method overcoming some of the problems and shortcomings of the prior art.

Another object of the invention is to provide an improved grille assembly and related method which requires fewer piece parts than at least one known assembly and method.

Another object of the invention is to provide an improved grille assembly and related method which provides a reduction in the cost of manufacture.

Another object of the invention is to provide an improved grille assembly and related method suitable for use with electro-deposition painting processes. How these and other objects are accomplished will become apparent from the following descriptions and from the drawings.

SUMMARY OF THE INVENTION

The invention is an improvement in a grille assembly of the type having two frame members and a grille bar supported by such frame members for pivoting movement about a grille bar axis. In the improvement, each frame member has a hole, the grille bar has an axle extending through the holes and the holes and the axle are cooperatively sized to provide a friction fit between such hole and axle, thereby frictionally retaining the grille bar in a selected position.

In a more specific aspect of the invention, each hole has a first diameter. Friction fits results which the grille bar axle is configured to have a second diameter at least equal to the first diameter. Most preferably, the second diameter is slightly greater than the first diameter (or, in other words, the first diameter is slightly smaller than the second diameter) so that the holes and axle are in interference-fitted frictional engagement with one another. (In the parlance of the mechanical arts, an interference fit results when the hole and axle have diameters such that the hole size "interferes" with axle insertion.)

In another, more specific aspect of the invention, it is to be noted that the holes could be precision-drilled to a particular size. However, that technique is relatively-expensive and inconsistent with the low selling price and competitiveness attending the sale of grilles.

Most preferably, a support shoulder is formed at each hole location by "extrusion punching" the frame members. (Extrusion punching is described below.) Such support shoulder extends from, preferably outwardly from, a frame member and has a terminus away from the frame member. The holes of each frame member are at the terminii of respective support shoulders which also extend away from the grille bar being supported thereby. In a specific embodiment, each support shoulder is shaped like a truncated cone.

In another aspect of the invention, the grille bars of the grille assembly are made of sheet material, e.g., aluminum or steel. Conveniently, the axle is rolled sheet material and has a hollow passage along the grille bar pivot axis. In a highly preferred embodiment, the axle has a longitudinal edge spaced slightly from the blade per se and spaced radially outwardly from the bar pivot axis. The edge and the blade per se thereby define a thin gap between them.

Since the sheet material has a degree of "shape memory," the axle is somewhat "springy" in radially inwardly directions. This offers a convenience for bar-axle-and-frame-hole assembly in that as the axle and a frame support shoulder are urged toward one another, the axle is squeezed radially inwardly and its diameter is diminished slightly from the axle diameter prevailing in a repose or "unsqueezed" state.

The grille assembly described above permits grille bars to be pivotally moved with respect to their supporting frame members to re-direct air flowing therethrough in the desired direction. However, once a grille bar position is selected, the friction fit or interference friction fit (as the case may be) holds a grille bar in the selected position without the need for auxiliary hardware.

However, there are occasions when the purchaser wishes to obtain a grille assembly in which the grille bars are "locked" in a prescribed position. That is, such bars cannot be pivoted or at least cannot be easily pivoted except, probably, by ruining the grille assembly.

To that end, a variant embodiment of the grille assembly has a grille bar with an axle deformed to a torque-transmitting axle configuration. At least one hole (of the two holes supporting a particular grille bar and bar axle) is deformed to a torque-transmitting hole configuration and the axle is in non-rotatable engagement with the hole, thereby permanently retaining the grille bar in a position with respect to the frame members.

In one, more specific embodiment, the axle configuration and the hole configuration are different from one another. As an example, the hole may be octagon-shaped and the axle may be square. In another, more preferred embodiment (preferred at least because it is easier to make), the axle configuration and the hole configuration are the same configuration, e.g., square.

Yet another aspect of the invention involves a new method for making a grille assembly. Such method includes the steps of providing a pair of frame members, each having a hole therethrough of a first diameter and providing a grille bar having an axle with a second diameter at least equal to the first diameter. The axle and the frame member holes are then urged into frictional engagement with one another.

In a more specific aspect of the method, the second diameter is greater than the first diameter and the urging step includes urging the axle and the frame member holes into interference-fitted frictional engagement with one another.

For ease of manufacture, the frame-member providing step includes forming a separate support shoulder extending from each respective frame. Each support shoulder is formed to have a terminus away from the frame and the forming step includes forming the hole of each frame member to be at the terminus of a respective support shoulder. If the grille assembly is to have one or more grille bars "locked" in position, the method includes the step of deforming the axle and the holes to a torque-transmitting shape. Such shape may include corners, e.g., a square shape.

It will be recalled that the axle has a hollow passage along the grille bar pivot axis and the end of such passage is visible at the end of the axle exposed at or near the hole in the frame. The deforming step includes inserting a shaped tool into the hole and urging the tool along the passage for a short distance. This activity deforms both the axle and the surrounding hole (by forcing them radially outwardly) to the same torque-transmitting shape. The grille bar is thereby locked in position.

Further details of the invention are set forth in the following detailed descriptions and in the drawings.

BRIEF DESCRIPTION OF THE DRAWINGS

FIG. 3 is a side elevation view of aspects of the new grille assembly taken along the viewing axis VA3 of FIG. 2.

FIG. 4 is a rear elevation view of aspects of the new grille assembly taken along the viewing axis VA4 of FIG. 3.

FIG. 9 is an elevation view, partly in section, of a grille assembly frame member, a die and a punch. Parts are shown in full representation and other parts are broken away.

FIG. 10 is an elevation view in section of a grille assembly frame member after having a hole and support shoulder formed therein using the die and punch.

DETAILED DESCRIPTION OF PREFERRED EMBODIMENTS

Figure 1:
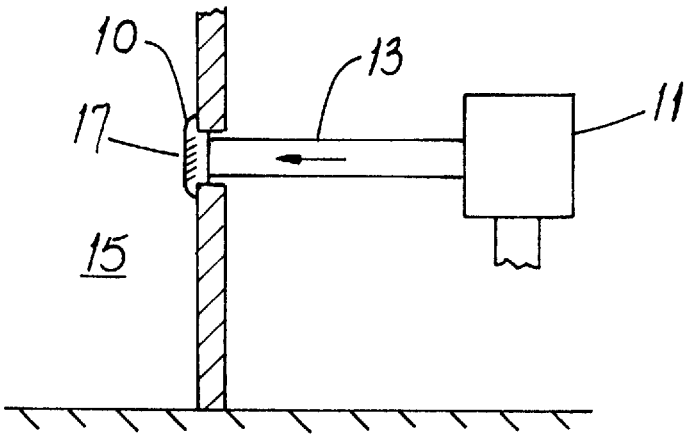
FIG. 1 is a cross-sectional elevation view of the new grille assembly shown in conjunction with heating, ventilating and air conditioning equipment. Parts are broken away.
Figure 2:
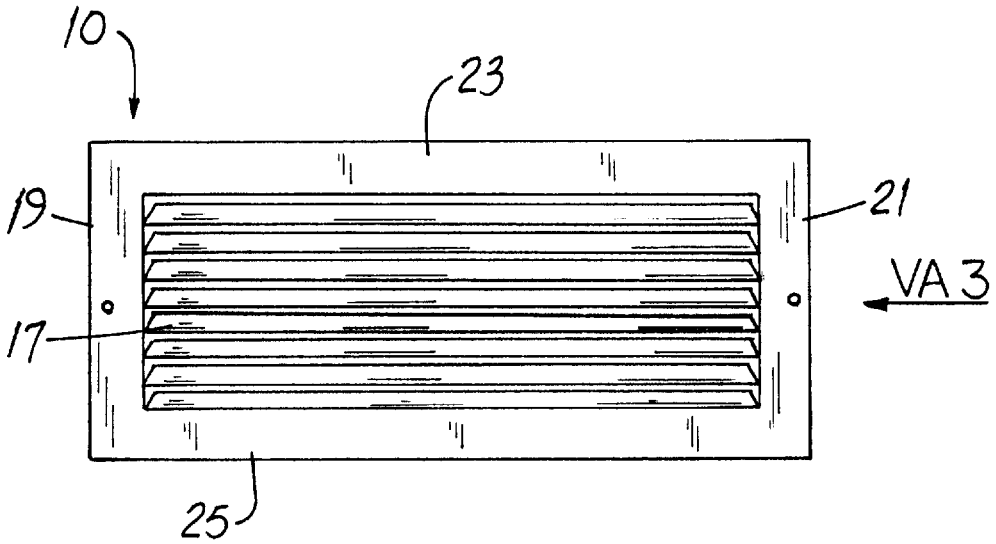
FIG. 2 is a front elevation view of the new grille assembly.

Before describing details of the new grille assembly 10 and related method, it will be helpful to have an understanding of but one exemplary way in which an assembly 10 is used. Referring first to FIGS. 1 and 2, FIG. 1 shows a component 11 of a heating, ventilating and air conditioning (HVAC) system which is connected to a grille assembly 10 by a duct 13. Air moving along the duct 13 in the direction of the arrow is expelled through the grille assembly 10 into the room 15. By positioning the assembly grille bars 17, the room occupant is able to direct the flow of such air.

The grille assembly of FIG. 2 has first and second frame members 19, 21, respectively, which are parallel to and spaced apart from one another. Such assembly 10 also has third and fourth frame members 23, 25, respectively, which are also parallel to and spaced apart from one another and perpendicular to the frame members 19, 21. In the grille assembly 10 of FIG. 2, the grille bars 17 extend between and are supported by the first and second frame members 19, 21. However, this arrangement is exemplary and grille bars 17 may (in the alternative or in addition) also be supported by the third and fourth frame members 23, 25. Grille assemblies 10 having only a single set of parallel grille bars 17 are known as single deflection assemblies while those with two sets of mutually perpendicular grille bars 17 are known as double deflection assemblies. And yet other configurations are possible.

Referring to FIGS. 1, 3 and 4, each of the first and second frame members 19, 21 includes a generally planar panel 27 extending away from the mounting face 29. The frame members 19, 21 forming the mounting face 29 are coplanar and as shown in FIG. 1, the mounting face 29 is parallel to and against the wall surface 16 of the room 15. The panel 27 of the second frame member 21 is shown in FIG. 3 and the panels 27 of both frame members 19, 21 are shown in FIG. 4. At least one hole 31, and preferably a plurality of holes 31, is formed in the frame members 19 and 21, and specifically, in the frame member panel 27. The holes 31 are of substantially the same size and are aligned along a linear axis 33.

Figure 5:
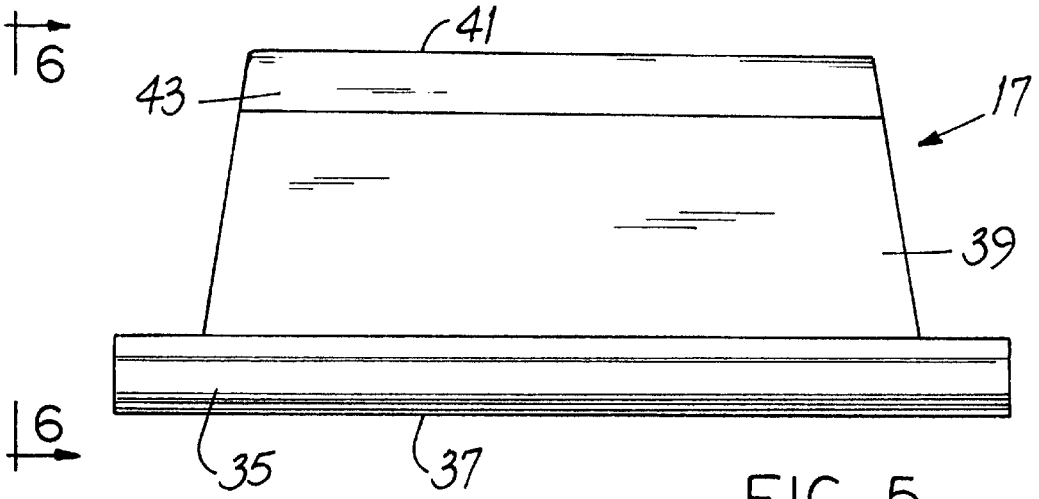
FIG. 5 is an elevation view of a grille bar used in the new grill assembly.
Figure 6:
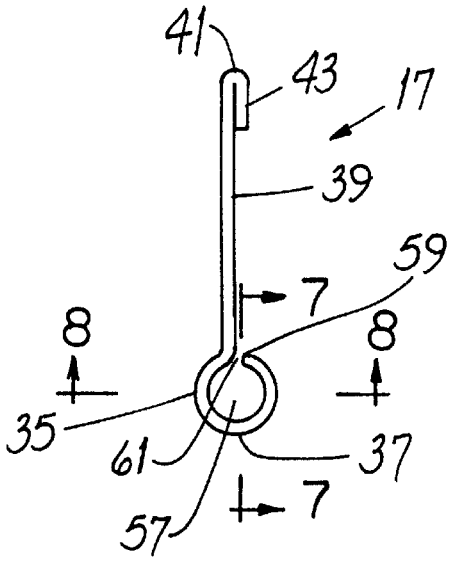
FIG. 6 is an edge elevation view of the grille bar of FIG. 5 taken along the viewing plane 6—6 thereof.

Referring next to FIGS. 5 and 6, details of the new grille bar 17 will now be set forth. The bar 17 includes a hollow, cylindrical axle 35 extending along and defining the proximal edge 37 of the bar 17. Such axle 35 is preferably rolled from the material, e.g., sheet steel, from which the bar 17 is made. Extending away from the axle 35 is a generally planar blade 39 which terminates at the bar distal edge 41 in a folded-over "hem 43." The hem 43 helps stiffen the blade 39, provides a neat appearance and avoid exposing a possibly-sharp edge. Such grille bar 17 is preferably fabricated of sheet metal although such bar 17 may be made from plastic or other rigid material.

As shown in FIG. 4, the end-to-end dimension D1 of the axle 35 is slightly greater than the center-to-center dimension D2 between the panels 27, of the first and second frame members 19, 21, respectively. So configured, the axle 35 extends slightly beyond each frame member 19, 21. The reason for the desirability of such dimensional relationship will become apparent.

Referring now to FIGS. 5, 6, 7 and 8, a grille bar 17 is supported by the frame members 19, 21 for pivoting movement about a grille bar axis 45. The grille bar axle 35 extends through the holes 31 and the holes 31 and the axle 35 are cooperatively sized to provide a friction fit between such hole 31 and axle 35, thereby frictionally retaining the grille bar 17 in a selected position.

Figure 7:
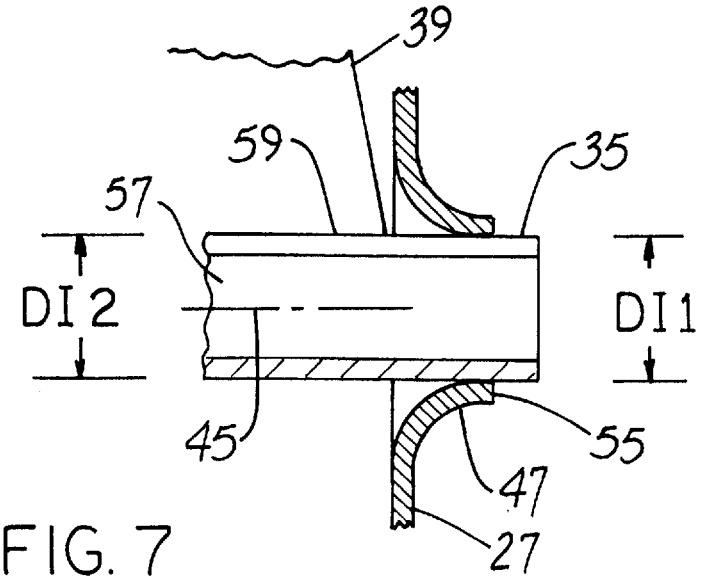
FIG. 7 is a section view of the grille bar of FIGS. 5 and 6 taken along the viewing plane 7—7 of FIG. 6 and shown in conjunction with a frame member. Parts are broken away.
Figure 8:
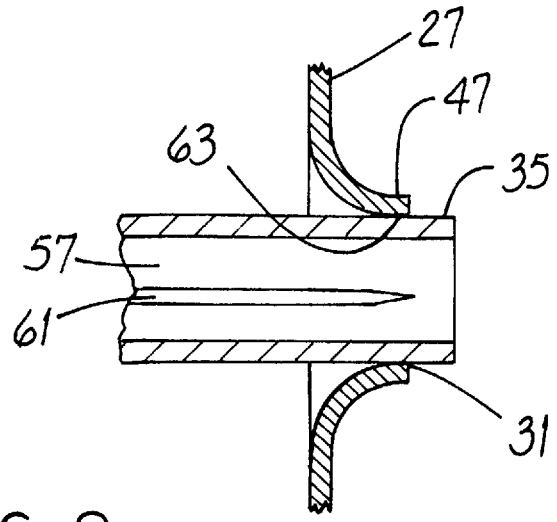
FIG. 8 is a section view of the grille bar of FIGS. 5 and 6 taken along the viewing plane 8—8 of FIG. 6 and shown in conjunction with a frame member. Parts are broken away.

As shown in FIG. 7, each hole 31 has a first diameter DI1. Friction fits results which the grille bar axle 35 is configured to have a second diameter DI2 at least equal to the first diameter DI1 and, most preferably, slightly greater than the first diameter DI1. When the hole 31 and axle 35 are configured so that the axle 35 has a diameter DI2 about equal to the hole diameter DI1, the hole 31 and axle 35 are in friction-fitted engagement with one another. And when DI2 slightly exceeds DI1, such hole 31 and axle 35 are in interference-fitted frictional engagement with one another. (In the parlance of the mechanical arts, an interference fit results when the hole 31 and axle 35 have diameters DI1, DI2, respectively, such that the hole size significantly "interferes" with easy axle insertion.)

It is to be appreciated that the holes 31 could be precision-drilled to a particular size. However, that technique is relatively expensive and inconsistent with the low selling price and competitiveness attending the sale of grille assemblies 10. Referring to FIGS. 7, 8, 9 and 10, most preferably, a support shoulder 47 is formed at each hole location by "extrusion punching" holes 31 in the frame members 19, 21 and/or 23, 25.

Extrusion punching involves using a die 49 with a cavity 49 having a cavity dimension CD and a punch 51 having a diameter DI3. The diameter DI3 is less than the dimension CD by at least about twice the thickness T of the material used to make the grille bar 17. More preferably, the diameter DI3 is well less than the dimension CD to permit the metal to extrude and thereby form the support shoulder 47 without using a profiled die.

When the punch 51 is driven into and through the panel 27, a support shoulder 47 is formed and a "knockout" disc 53 of material is removed. Such support shoulder 47 extends from, preferably outwardly from, a frame member 19, 21, 23, 25 and has a terminus 55 away from the frame member 19, 21, 23, 25. The holes 31 of each frame member 19, 21, 23, 25 are at the terminii 55 of respective support shoulders 47 which also extend away from the grille blade 39 being supported thereby. In a specific embodiment, each support shoulder 47 is shaped somewhat like a truncated cone.

Referring again to FIGS. 6, 7 and 8, the axle 35 has a hollow passage 57 along the grille bar pivot axis 45. In a highly preferred embodiment, the axle 35 has a longitudinal edge 59 spaced slightly from the blade 39 per se and spaced radially outwardly from the bar pivot axis 45. The edge 59 and the blade 39 per se thereby define a thin gap 61 between them.

Since a preferred sheet material has a degree of "shape memory," the axle 35 is somewhat "springy" in radially inwardly directions. This offers a convenience for bar-axle-and-frame-hole assembly in that as the axle 35 and a frame support shoulder 47 are urged toward one another, the axle 35 is squeezed radially inwardly and its diameter DI2 is diminished slightly from the axle diameter DI2 prevailing in a repose or "unsqueezed" state.

Using holes 31 with respective support shoulders 47 to mount an axle 35 is preferred to precision-drilling holes 31 in the frame members. The former approach is less expensive, provides a bit more tolerance "forgiveness," and provides a larger-area friction and bearing surface 63 on the shoulder 47 to engage the axle 35.

The grille assembly 10 described above permits grille bars 17 to be pivotally moved with respect to their supporting frame members 19, 21, 23, 25 to re-direct air flowing therethrough in the desired direction. However, once a grille bar position is selected, the friction fit or interference friction fit (as the case may be) holds a grille bar 17 in the selected position without the need for auxiliary hardware.

Figure 11:
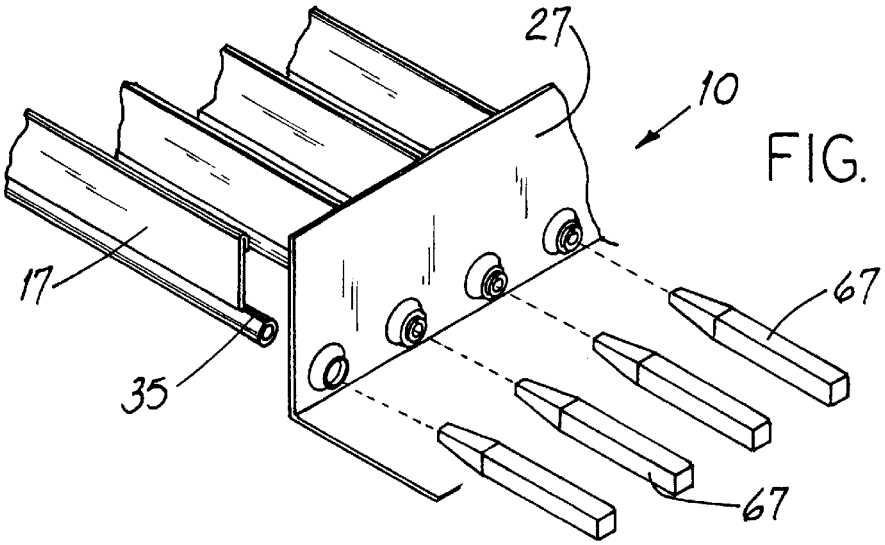
FIG. 11 is a perspective view of portions of the new grille assembly shown in conjunction with deforming tools. Parts are broken away.
Figure 12:
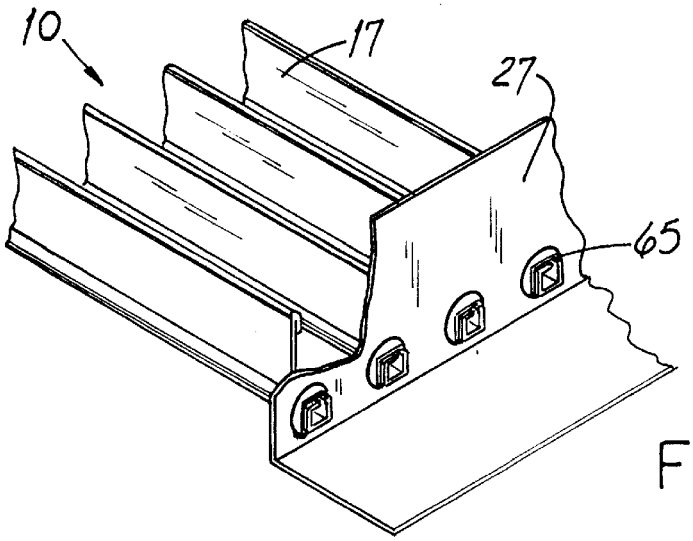
FIG. 12 is a perspective view of portions of the new grille assembly after having been deformed to a torque-transmitting shape by the tools shown in FIG. 11.

Referring next to FIGS. 11 and 12, there are occasions when the purchaser wishes to obtain a grille assembly 10 in which the grille bars 17 are "locked" in a prescribed position. That is, such bars 17 cannot be pivoted or at least cannot be easily pivoted except by, probably, ruining the grille assembly 10.

To that end, a variant embodiment of the grille assembly 10 has a grille bar 17 with an axle 35 deformed to a torque-transmitting shape 65. At least one hole 31 (of the two holes 31 supporting a particular grille bar 17 (and bar axle 35) is also deformed to a torque-transmitting shape 65 and the axle 35 is in non-rotatable engagement with the hole 31, thereby permanently retaining the grille bar 17 in a position with respect to the frame members 19, 21, 23, 25. Axle and hole/support shoulder deformation is by holding the panel 27 and axle 35 stationary and urging a deforming tool 67 along the axis 45 until suitable deformation occurs.

(As used in this specification, the phrase "torque-transmitting shape" means any random shape or regular or irregular geometric shape other than a circle. For example, ovals, squares and hexagons are torque-transmitting shapes in that an axle 35 having such a shape is, when turned, capable of transmitting torque to the axle hole 31 and its surrounding support shoulder 47 by mechanical engagement rather than merely by friction.)

Figure 13:
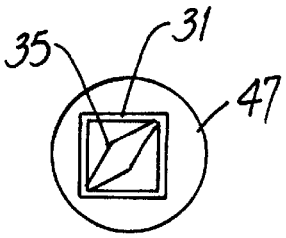
FIGS. 13, 14 and 15 are end elevation views of a support shoulder, shoulder hole and grille bar axle having other torque-transmitting shapes.
Figure 14:
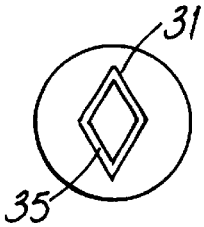
Figure 15:
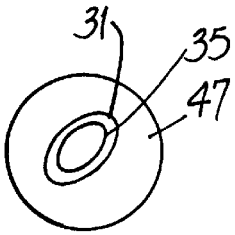

In one, more specific embodiment shown in FIG. 13, the axle configuration and the hole configuration are different from one another. The hole 31 is square and the axle 35 is diamond-shaped. As another example, the hole 31 may be octagon-shaped and the axle 35 may be square. In other, more preferred embodiments (preferred at least because of ease of manufacture) shown in FIGS. 12, 14 and 15, the axle configuration and the hole configuration are the same. In FIG. 15, such configuration is oval, in FIG. 14, such configuration is diamond-shaped and in FIG. 12, the most highly preferred, the configuration is square.

Referring to FIGS. 1–15, yet another aspect of the invention involves a new method for making a grille assembly 10. Such method includes the steps of providing a pair of frame members 19, 21 or 23, 25 each having a hole 31 therethrough of a first diameter DI1 and providing a grille bar 17 having an axle 35 with a second diameter DI2 at least equal to the first diameter DI1. The axle 35 and the frame member holes 31 are then urged into frictional engagement with one another. In a more specific aspect of the method, the second diameter DI2 is greater than the first diameter DI1 and the urging step includes urging the axle 35 and the frame member holes 31 into interference-fitted frictional engagement with one another.

For ease of manufacture, the frame-member providing step includes forming a separate support shoulder 47 extending from each respective frame member 19, 21, 23, 25. Each support shoulder 47 is formed to have a terminus 55 away from the frame 19, 21, 23, 25 and the forming step includes forming the hole 31 of each frame member 19, 21, 23, 25 to be at the terminus 55 of a respective support shoulder 47. If the grille assembly 10 is to have one or more grille bars 17 "locked" in position, the method includes the step of deforming the axle 35 and at least one axle-receiving hole 31 to a torque-transmitting shape 65. Such shape 65 may include corners, e.g., a square shape.

It will be recalled that the axle 35 has a hollow passage 57 along the grille bar pivot axis 45 and the end of such passage 57 is visible at the end of the axle 35 exposed at or near the hole 31 in the frame member 19, 21, 23, 25. The deforming step includes inserting a shaped tool 67 into the hole 31 and urging the tool 67 along the passage 57 for a short distance. This activity deforms both the axle 35 and the surrounding hole 31 (by forcing them radially outwardly) to the same torque-transmitting shape. The grille bar 17 is thereby locked in position.

Figure 16:
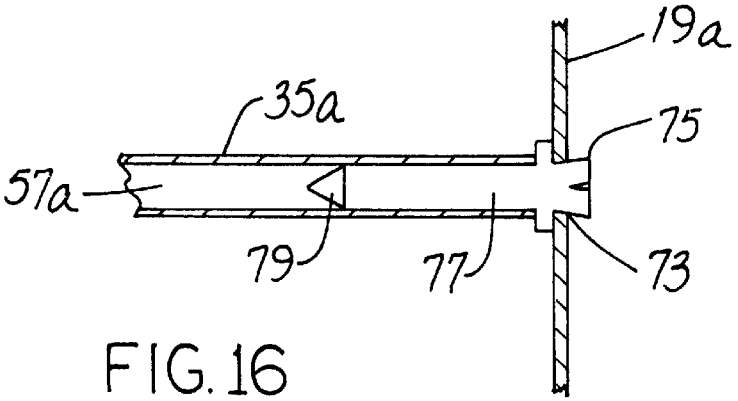
FIG. 16 PRIOR ART
FIG. 16 is a sectional elevation view of a prior art approach to mounting a grille bar in a frame member.

FIG. 16 shows a prior art way of supporting a grille bar 17 in a frame member 19*a* prior to the advent of the invention. A hole 73 was formed in the frame member 19*a*, the head 75 of a retention pin 77 was inserted through the hole 73 and the pin head 75 staked to expand it. The axle 35*a* was then urged onto the pointed end 79 of the pin 77. The passage 57*a* in the axle 35*a* and pin 77 are cooperatively sized to provide at least a friction fit. The pin 77 was stationary with respect to the frame member 19*a* and grille bars were held in a selected position by the friction between axle 35*a* and pin 77. If the frame member 19*a* and grille bars are painted using an electro-deposition process, an electrically-conductive metal pin 77 was used.

While the principles of the invention have been shown and described in connection with a few preferred embodiments, it is to be understood clearly that such embodiments are by way of example and are not limiting.

What is claimed:

1. In a grille assembly connected to an HVAC system by a duct, the grille assembly having two frame members and a grille bar extending along a grille bar axis and supported by such frame members, and wherein the frame members are substantially coplanar, and each frame member has a mounting face against the same wall surface of a room and a single panel extending away from the mounting face perpendicular to the wall surface, and wherein the panels are generally parallel to one another, the improvement wherein:

each panel has a round hole;

the bar is opaque and has a proximal edge and a hollow axle integrally formed with the bar and extending along the proximal edge and through the holes;

the bar includes a blade and the blade and the axle are formed of the same material;

each hole and the axle are cooperatively sized to provide a friction fit between such hole and axle, thereby permitting rotation of the axle in the panels and frictionally retaining the grille bar in a rotational position.

2. The grille assembly of claim 1 wherein:

at least one panel has a support shoulder extending therefrom, such support shoulder having a terminus away from the panel; and the hole of each panel is at the terminus of a respective support shoulder.

3. The grille assembly of claim 2 wherein each support shoulder extends away from the grille bar.

4. The grille assembly of claim 2 wherein the support shoulder is shaped like a truncated cone.

5. In a grille assembly having two frame members and a grille bar supported by such frame members, and wherein each frame member has a mounting face and a panel extending away from the mounting face, the improvement wherein:

each panel has a hole;

the bar has a blade and an axle having a portion coextensive with the blade and having a separate axle end extending through each of the respective holes;

that portion of the axle coextensive with the blade is round;

at least one axle end is deformed to a torque-transmitting axle shape;

at least one hole is deformed to a torque-transmitting hole shape; and the said at least one axle end is in non-rotatable engagement with the deformed hole, thereby permanently retaining the bar in a position with respect to the frame members.

6. The grille assembly of claim 5 wherein the said at least one axle end is deformed radially outwardly and wherein the torque-transmitting axle shape and the torque-transmitting hole shape are different from one another.

7. The grille assembly of claim 5 wherein the torque-transmitting axle shape and the torque-transmitting hole shape are the same shape.

8. In an air-flow-directing grille assembly having two frame members and a grille bar supported by such frame members for pivoting movement about a grille bar axis, the improvement wherein:

each frame member has a support shoulder extending therefrom and having a terminus away from such frame members;

each frame member has a hole at the terminus of the support shoulder extending therefrom;

the grille bar has a hollow axle parallel to a bar proximal edge;

the grille bar includes an opaque, solid blade extending away from the proximal edge and terminating in a distal edge spaced from the proximal edge;

the axle includes an axle edge;

the grille bar includes a gap between the blade and the axle edge;

the axle is spaced from the distal edge and extends through the holes;

each support shoulder extends away from the grille bar; and each hole and the axle are cooperatively sized to provide a friction fit with the axle, thereby frictionally retaining the grille bar in a position.

9. A method for making an air-flow-directing grille assembly including:

providing a pair of frame members;

forming a separate support shoulder extending from each respective frame member, each shoulder having a terminus outwardly away from the frame members and a hole at such terminus and having a first diameter;

providing a grille bar having a distal edge, a proximal edge, an opaque, solid blade extending between the edges and a hollow axle integrally formed with the bar, extending along the proximal edge and having a second diameter at least equal to the first diameter; and urging the axle and the frame member holes into frictional engagement with one another, thereby positioning the blade and the frame members substantially against one another.

* * * * *